United States Patent [19]

Van Bogaert et al.

[11] Patent Number: 4,909,285

[45] Date of Patent: Mar. 20, 1990

[54] THREAD CLIP

[75] Inventors: Philippe Van Bogaert, Schaarbeek; Frank Ampe, Leffinge-Middelkerke; Jozef Verhulst, Zillebeke; Hugo Markey, Langemark, all of Belgium

[73] Assignee: Picanol, N.V., Ypres, Belgium

[21] Appl. No.: 269,692

[22] Filed: Nov. 10, 1988

[30] Foreign Application Priority Data

Nov. 12, 1987 [BE] Belgium ..... 8701273

[51] Int. Cl.[4] ..... D03D 47/34

[52] U.S. Cl. ..... 139/450; 242/150 M; 188/65.1

[58] Field of Search ..... 139/425, 435, 452, 450; 242/150 R, 150 M; 188/65.1

[56] References Cited

U.S. PATENT DOCUMENTS 2,912,185 11/1959 Vossen ..... 139/450
3,633,711 1/1972 Pfarrwaller ..... 188/65.1
4,192,357 3/1980 Tanaka et al. ..... 139/450
4,450,874 5/1984 Brouwer et al. ..... 139/450
4,494,579 1/1985 Grandvallet et al. ..... 139/450

FOREIGN PATENT DOCUMENTS 39561 11/1981 European Pat. Off. .

*Primary Examiner*—Henry S. Jaudon
*Attorney, Agent, or Firm*—Bacon & Thomas

[57] ABSTRACT

A thread clip including a clamping mechanism (1) consisting of a first jaw (2) and a second jaw (3); a spring mechanism (4) which presses the clamping mechanism jaws (1) together; an electromagnetic device (5) which can open the clamping mechanism against the force of the above-mentioned spring mechanism (4); a cam mechanism (6) which can close the clamping mechanism (1) against the force of the electromagnetic device (5); and a mechanism (7) which on closing of the clamping mechanism (1) by means of the cam mechanism (6) presses the different elements of the clamping mechanism (1) against each other with a certain clamping force.

8 Claims, 3 Drawing Sheets

THREAD CLIP

BACKGROUND OF THE INVENTION

This invention concerns a thread clip, and more especially an electromechanical thread clip for weaving machines.

This thread clip is particularly suitable for use as a weft thread clip in a mechanism for preparing the weft thread on airjet weaving machines.

The invention also concerns a thread clip which in the rest condition is automatically closed, and which can be opened at points in time which can be simply regulated, and closed again very precisely at particular times with a predetermined, preferably large pressure.

SUMMARY OF THE INVENTION

For this purpose, the present invention also concerns a thread clip which comprises a clamping mechanism formed by a first and a second jaw; an elastic mechanism which presses the clamping mechanism jaws together; an electromagnetic device which can open the clamping mechanism against the force of said elastic mechanism; a cam mechanism which closes the clamping mechanism against the force of said electromagnetic device; and a mechanism which on closing of the clamping mechanism by means of the cam mechanism presses the clamping mechanism jaws together with a definite clamping force.

The moment of opening of the thread clip can be simply controlled by regulating the activation of the electromagnetic device electrically. Also, by using a cam mechanism to close the clamping mechanism, the moment of closing can be defined precisely, and by using the above mentioned mechanisms jaws to press the clamping mechanism together on closing by means of the cam mechanism, the clamping force can be defined precisely.

BRIEF DESCRIPTION OF THE DRAWINGS

In order to explain the characteristics of the invention, by way of example only and without being limitative in any way, a preferred embodiment is described below, with reference to the accompanying drawings, where:

As shown in FIGS. 1 to 3, the thread clip comprises a clamping mechanism 1, consisting of a fixed first jaw 2 and a movable second jaw 3; a spring mechanism 4 which biases the clamping mechanism 1 closed; an electromagnetic device 5 to open the thread clip or said clamping mechanism 1; a cam mechanism 6 which closes the clamping mechanism 1 against the force of the electromagnetic device 5; and a mechanism 7 which on closing of the clamping mechanism 1 by means of the cam mechanism 6 presses the second jaw 3 against the first jaw 1 with a definite clamping force.

Figure 1:
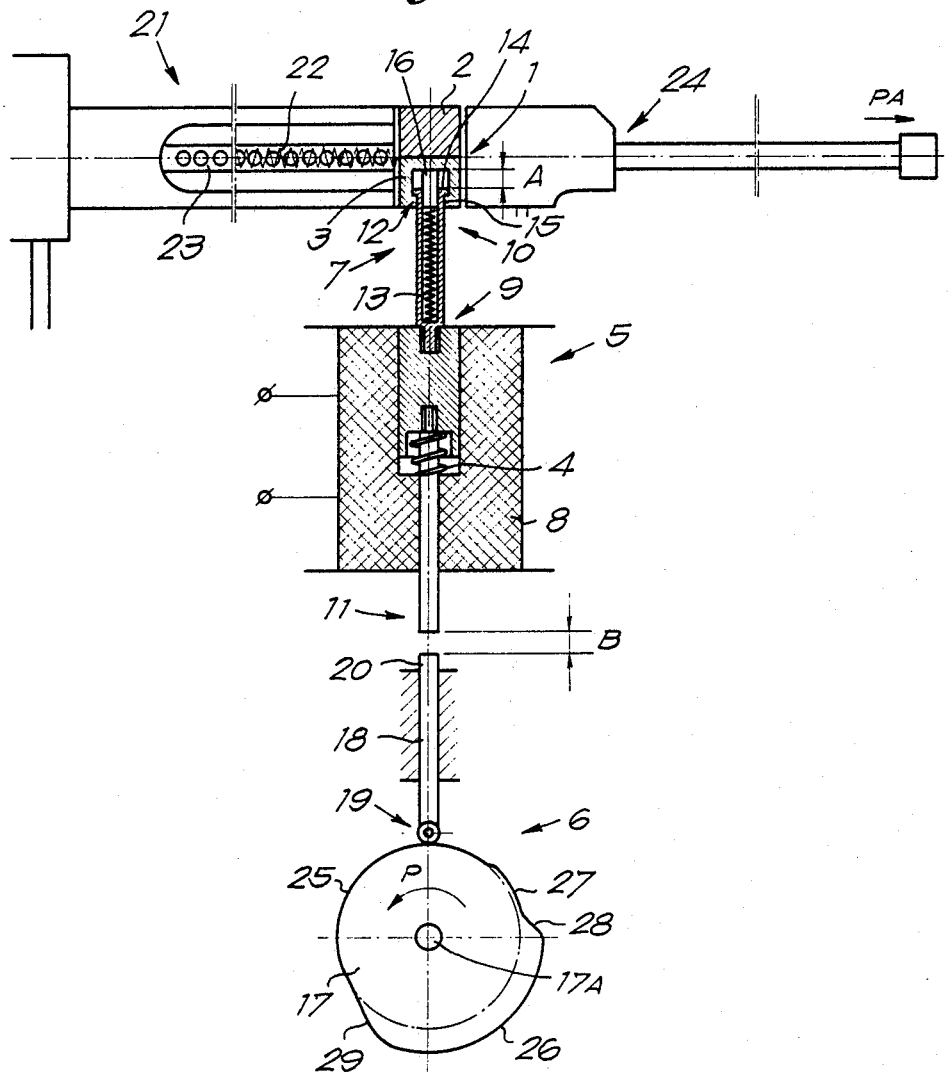
FIG. 1 shows a thread clip, constructed according to the teachings of the present invention, in the rest position.

The electromagnetic device 5 comprises a solenoid 8 and an element 9 which can be moved by this solenoid 8, one element 10 of which carries the above-mentioned second jaw 3 and another element 11 of which operates with the cam mechanism 6. The movement of element 9 thus effects the opening and closing operation of clamping mechanism 1.

In the embodiment shown, the above-mentioned elastic mechanism 4 comprises a pressure spring which pushes the element 9 and thus said second jaw 3 attached to it towards the first jaw 2.

The mechanism 7, which, on closing of the clamping mechanism 1 by means of the cam mechanism 6 presses the second jaw 3 against the first fixed jaw 2 with a certain clamping force comprises a means for engaging the second jaw 3 with the movable element 9, which allows the second jaw 3 to move with respect to said movable element 9 against the direction of closing of the clamping mechanism 1, and an elastic mechanism 13, consisting of a pressure spring, which opposes the movement of the second jaw 3 with respect to the element 9.

The above-mentioned engagement means 12 comprises collars 14 and 15, which cooperate with each other, mounted on the element 10 of the element 9 and on the second jaw 3 respectively, such that the second jaw 3 can be moved over a given distance A with respect to the element 9. The elastic mechanism 13 consists of a pressure spring mounted at the component 10 of the element 9 and which pushes with a certain pretension against the underside of the jaw 3 by means of a spacer 16. This pretension is determined by the length of the spacer 16 and can therefore be regulated by simply modifying the spacer.

The elastic mechanisms 4 and 13 consist of a weak spring and a strong spring, respectively, such that in the rest position (FIG. 1) the first spring 4 does not compress the second spring 13.

In the embodiment shown, the cam mechanism 6 comprises a cam 17 and a cam follower 18. The cam follower 18 consists of a rod or bar which can slide axially, one end 19 of which operates with the cam 17 while the other end 20 can make contact with said end 11 of the element 9.

The shape of the cam 17 depends on the purpose for which the thread clip is used. In the embodiment shown, the thread clip is part of a mechanism for preparing the weft thread on weaving machines which use a thread accumulator 21 of the type in which a weft thread 22 is blown spirally against the wall of a perforated tube 23, as known from Dutch patent application No. 8602741 (U.S. Pat. No. 4,821,781). The tube 23 is closed off by the jaws 2 and 3, which can either grasp the weft thread 22 in the required way or release it from the tube 23. Beside the clamping mechanism 1, and opposite the tube 23 is a blower nozzle 24, which transports the weft thread 22.

Figure 2:
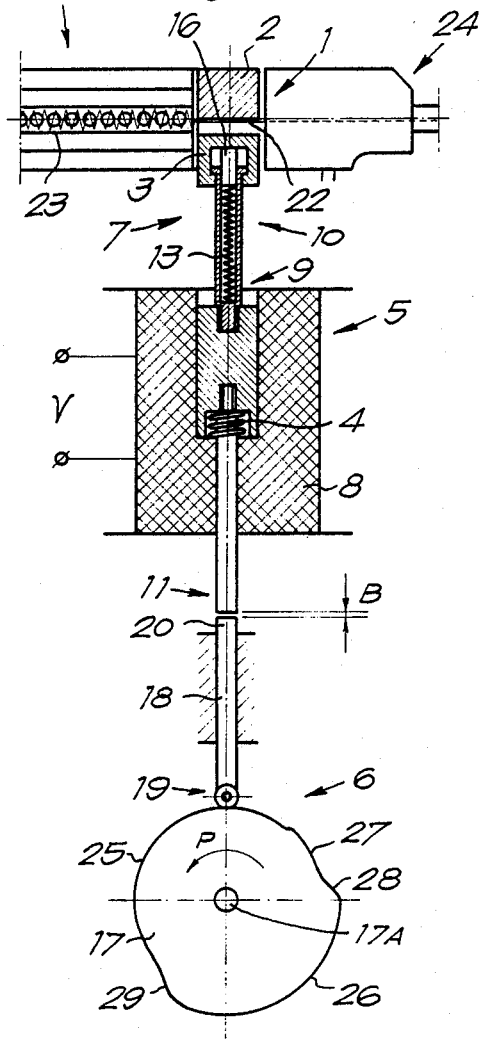
FIG. 2 shows the thread clip of FIG. 1 in the open position.
Figure 3:
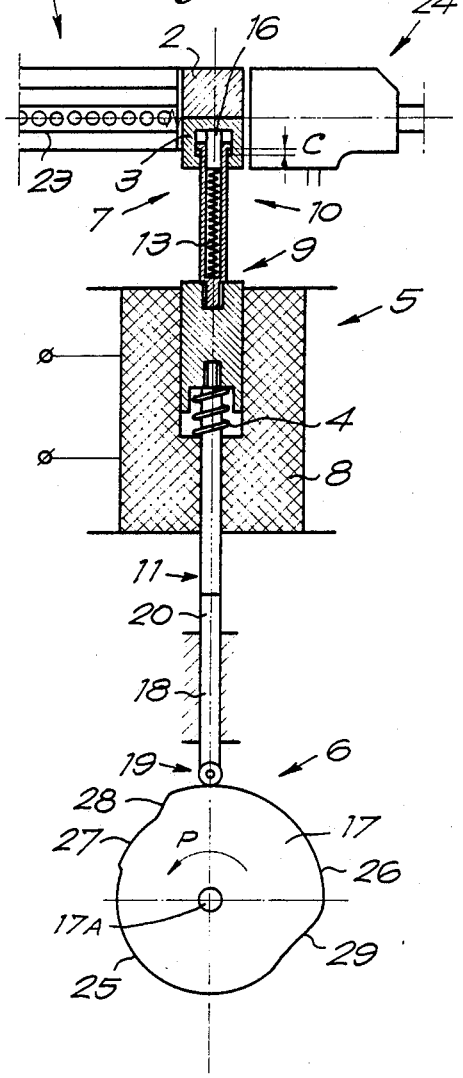
FIG. 3 shows the thread clip of FIG. 1 in the closed position.

In this embodiment, the cam 17 is preferably of the type which, as shown in FIGS. 1 to 3, is made up of three sections 25 to 27, each of which determines a certain position of the cam follower 18. The figures also show the two most important transition sections 28 and 29.

In the first section 25 the position of the cam follower 18 is such that there is always play B between the end 20 of the cam follower 18 and the element 11 of the above-mentioned element 9, both in the rest position of the thread clip as in FIG. 1 and in the position when the clamping mechanism 1 is opened as in FIG. 2.

In section 26, in which the cam 17 has the largest radius, the cam follower 18 makes contact with the element 9, such that not only is the clamping mechanism 1 closed, but also the elastic mechanism 13 is compressed a distance C as shown in FIG. 3.

In the intermediate section 27 the cam follower 18 is moved so that the minimal play B shown in FIG. 2 is taken up before the cam follower 18 makes contact with the above-mentioned section 26.

Figure 4:
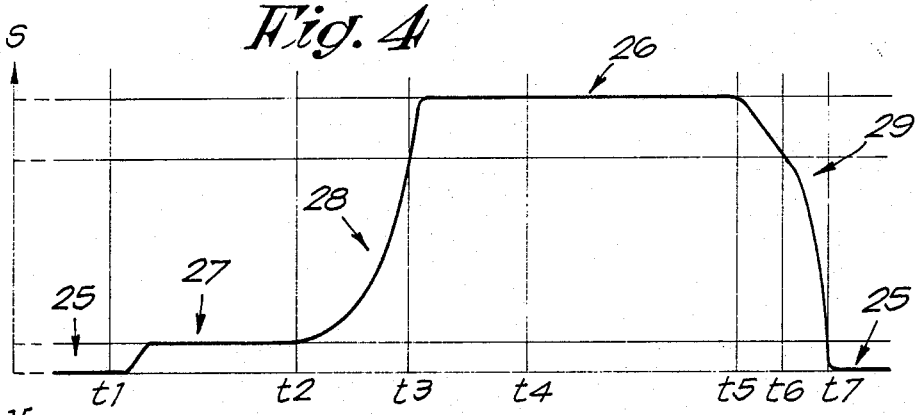
FIG. 4 shows geographically the cam timing of the invention.
Figure 5:
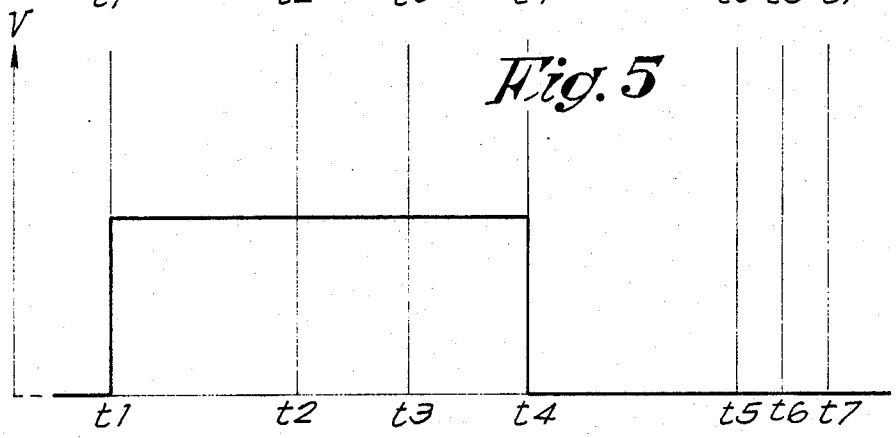
FIG. 5 shows graphically the timing of the electromagnetic device activation.
Figure 6:
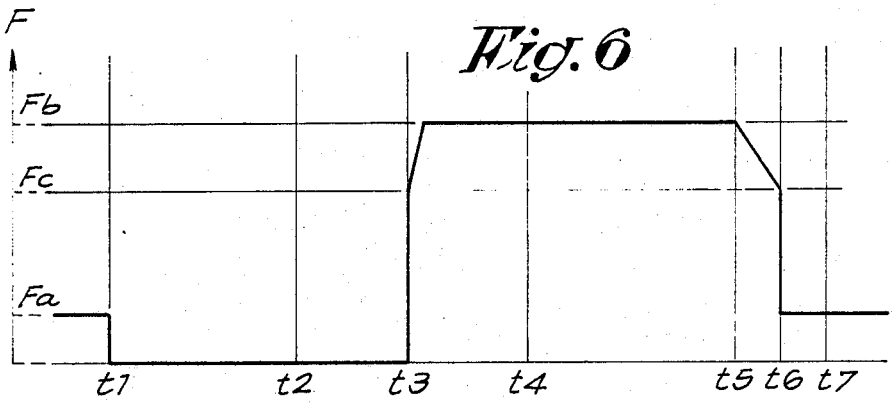
FIG. 6 shows graphically the clamping force of the thread clip, for a cam path as in FIG. 4, and for the activation of the electromagnetic device as in FIG. 5.

The operation of the thread clip is now described with reference to the embodiments shown in the figures, in particular for use as a weft thread clip in a mechanism for preparing the weft threads on weaving machines. This operation is further illustrated by the diagrams in FIGS. 4 to 6. FIG. 4 represents the shape S (effective radius) of the cam 17 as a function of time. FIG. 5 shows how the voltage V is switched on for energizing the solenoid 8, and FIG. 6 shows the curve of the clamping force F of the clamping mechanism 1.

In the example shown, it is assumed that the pressure spring 4 closes the clamping mechanism 1 with a small clamping force Fa, as shown in FIG. 1, when the thread clip is in the rest position. Since the clamping mechanism 1 closes off the tube 23, a spiral accumulation of thread is formed in this tube. At the time t1 of insertion of a thread into the shed, the solenoid 8 is energized and the element 9 is pushed down, as shown in FIG. 2, thus opening the thread clip. At that moment, the thread 22 is released from the tube 23 and the blower nozzle 24 transports it in the direction of the shed.

Thereafter, section 27 of the cam 17 reaches the cam follower 18 and the play B is taken up.

At time t2, the cam follower 18 comes in contact with the section 28 of the cam 17, thus moving the jaws 2 and 3 towards each other.

The cam 17 and its drive are designed so that the jaws 2 and 3 make contact with each other at the time t3 at which the front of the weft thread 22 reaches the end of the shed. From time t3, the elastic mechanism 13 is compressed because the element 9 is pushed further up, so that the collars 14 and 15 disengage. The preset force Fc of the elastic mechanism 13 is suddenly transmitted to the clamping mechanism 1, via spacer 16 so that the force F in the clamping mechanism 1 suddenly rises to the value Fc.

As the cam 17 turns further, the elastic mechanism 13 is compressed further until the cam follower 18 makes contact with the section 26, so that the force F rises still higher to a certain value Fb.

The high and known value of the forces Fc and Fb ensures that the thread is stopped suddenly and precisely. The voltage V to the solenoid 8 is then switched off again at time t4. The cam 17, however, keeps the clamping mechanism 1 closed until the cam follower 18 leaves section 26 and reaches section 29. As a result, between t5 and t6 the distance C becomes smaller and the force F in the clamping mechanism 1 decreases. From the time t6, at which the collars 14 and 15 again cooperate with one another, the force F suddenly decreases to the value Fa, so that the rest position is reached once more.

If a weaving machine with several weft threads, e.g. in different colors, is used, each weft thread will have its own accumulator 21 and thread clip. If a particular weft thread does not have to be inserted during one or more insertion cycles, the electromagnetic device 5 of the corresponding thread clip remains deenergized. The clamping mechanism 1 will then remain closed during the entire revolution of the cam 17 and the clamping force will vary from Fa to Fb. If a particular weft thread has to be inserted, the corresponding thread clip will be opened by the electromagnetic mechanism by activating an appropriate control.

If necessary, the thread clip according to the invention also enables insertion of weft threads into the shed to be cancelled immediately. If for example an incorrect insertion is detected, the electromagnetic device 5 can be prevented from energizing as soon as the next weaving cycle, irrespective of whether or not the weaving machine makes a few more revolutions before coming to a halt.

The thread clip is preferably equipped with a manually operated contact (not shown in the figures) for energizing the electromagnetic device 5. This allows the clamping mechanism 1 to be opened easily if, e.g., threads must be inserted into the accumulator 21 and the clamping mechanism 1.

Clearly, the thread clip according to the invention can also be used at other points in the weaving machine besides the mechanism for preparing the weft thread.

Clearly also, the cam 17 can be different in shape depending on the use of the thread clip, and the cam follower 18 can also be integral with the element 9. In a variant, the cam follower 18 has the shape of a lever, one end of which operates with the cam 17 and the other end of which operates with the end 11 of the element 9.

The present invention is not limited to the embodiments described by way of example and shown in the drawings; on the contrary, such a thread clip can be made in different forms and dimensions while still remaining within the scope of the invention.

We claim:

1. A thread clip, comprising:

clamping means for clamping a thread, said clamping means having a pair of opposed jaws movable between open and closed positions;

first and second spring means arranged to bias said jaws towards a non-driven closed position whereat at least one of said spring means exerts a jaw closing force between said jaws;

first jaw drive means arranged to move said jaws towards an open position against the bias of at least said first spring means upon actuation; and second jaw drive means arranged to drive said jaws towards a driven closed position in opposition to the motion of said first jaw drive means upon actuation;

wherein said second jaw drive means and said first and second spring means are arranged to cooperate to exert a predefined clamping force between said jaws at said driven closed position.

2. A thread clip as claimed in claim 1, wherein said second spring means is arranged to define the magnitude of jaw closing force exerted by said first spring means in both said closed positions.

3. A thread clip as claimed in claim 2, wherein said second spring means comprises spacer means and a spring arranged to bias said jaws towards a closed position by biasing said spacer means towards one of said jaws.

4. A thread clip as claimed in claim 1, wherein said first jaw drive means comprises a solenoid and a first movable element, said first movable element arranged to move one of said jaws towards said open position upon actuation of said solenoid.

5. A thread clip as claimed in claim 1, further comprising a second movable element operatively disposed between said one of said jaws and said first movable element so that the actuation of said solenoid causes said first movable element to cause said second movable element to move said one of said jaws towards said open position.

6. A thread clip as claimed in claim 5, wherein said second spring means comprises spacer means and a spring arranged to bias said jaws towards a closed position by biasing said spacer means towards one of said jaws, and wherein said second movable element contacts said spring to bias said one of said jaws towards one of said closed positions via said spacer means.

7. A thread clip as claimed in claim 6, wherein said second jaw drive means comprises a cam and a cam follower, said cam arranged to drive said cam follower to a first position whereat said cam follower supplies driving force to drive said jaws towards said driven closed position by driving said first movable element such that said first movable element drives said second movable element to bias said one of said jaws towards said driven closed position.

8. A thread clip as claimed in claim 1, wherein said second jaw drive means comprises a cam and a cam follower, said cam arranged to drive said cam follower to a first position whereat said cam follower supplies driving force to drive said jaws towards said driven closed position.

* * * * *